United States Patent [19]

Kunstadt

[11] Patent Number: 4,930,389

[45] Date of Patent: Jun. 5, 1990

[54] SELF-TENSIONING TRUSSROD SYSTEM

[76] Inventor: Robert M. Kunstadt, 470 West End Ave., New York, N.Y. 10024

[21] Appl. No.: 373,159

[22] Filed: Jun. 29, 1989

[51] Int. Cl.[5] ..... G10D 3/12

[52] U.S. Cl. ..... 84/293; 84/313

[58] Field of Search ..... 84/293, 313

[56] References Cited

U.S. PATENT DOCUMENTS

| | | | |
|---|---|---|---|
| 1,912,106 | 5/1933 | Turturro | 84/293 |
| 2,335,249 | 11/1943 | Gugino | 84/293 |
| 3,143,028 | 8/1964 | Fender | 84/293 |
| 3,437,001 | 4/1969 | Kraft | 84/312 |
| 3,535,975 | 10/1970 | Broussard | 84/293 |

*Primary Examiner*—Lawrence R. Franklin

[57] ABSTRACT

A stringed musical instrument of the type having a trussrod acting under tension for reinforcing the neck against warping is provided with a system for automatically increasing the tension on the trussrod in proportion to the tension on the strings, thus maintaining both neck straightness and optimal string height with respect to the fretboard and any pickups the instrument may have. The instrument's tailpiece pivots so as to redirect the string tension into tension applied to the trussrod. The tailpiece may be provided with fine tuners or with a tremolo bar. Even on operation of the tremolo bar, there is no tendency for the neck to warp, because the changes in string tension caused by the tremolo bar are automatically and immediately counteracted by the trussrod.

7 Claims, 4 Drawing Sheets

SELF-TENSIONING TRUSSROD SYSTEM

FIELD OF THE INVENTION

This invention relates to the field of stringed musical instruments. More particularly, it relates to such instruments utilizing a trussrod internal to the neck in order to counteract the warping pressure exerted on the neck by the strings.

PRIOR ART

Using the electric guitar as an example, the conventional instrument has a body, fretted neck (with a head) and strings as its principal parts. The strings are suspended between the bridge (affixed to the body), and the string nut (affixed to the end of the neck where it widens into the head). Because the string tension is applied to the neck, a good instrument has an adjustable steel trussrod to pre-tension the neck against the string pull. Using a conventional trussrod, in order to achieve a low action it is necessary to carefully adjust a nut or screw provided at one end of the rod, so that when full string tension is applied to the neck, the trussrod exactly counterbalances such tension. If the tension of the strings changes (which can be caused by the aging of the strings; by an intentional change of string gauge by the guitarist; or by the action of a tremolo system used to induce changes in string pitch), it can become necessary to readjust the trussrod in order to maintain neck straightness. Such adjustment may be beyond the capability of the musician and require the services of a repair technician, with consequent expense and delay.

OBJECT OF THE INVENTION

It can thus be appreciated that there is a need for a stringed musical instrument in which the trussrod tension is adjusted automatically in response to changes in string tension, whatever their cause. This should be accomplished without the need for human activity of any kind, whether by the guitarist or a repair technician. Moreover, such adjustment should ideally be instantaneous, acting in response to the guitarist's employing of the tremolo system in those instances in which the guitar is provided with such a system.

SUMMARY OF THE INVENTION

These objects are accomplished by the invention in the following manner. The tailpiece of the instrument, rather than being stationary on the body, constitutes the upper extremity of a lever which is pivoted in the middle on a shaft journaled on bearings housed within the body. The lower extremity of the tailpiece therefore moves in opposition to the motion of its upper extremity. At the lower extremity of the tailpiece, it is provided with a pullrod which connects to the lower extremity of a hinge affixed to the heel of the neck. One end of the neck's trussrod extends through said hinge, and is anchored at its other end at the headstock of the neck. Hence, tensioning of the strings automatically induces a countervailing tensioning of the trussrod, whereby the straightness of the neck is maintained.

DESCRIPTION OF THE INVENTION

Figure 1:
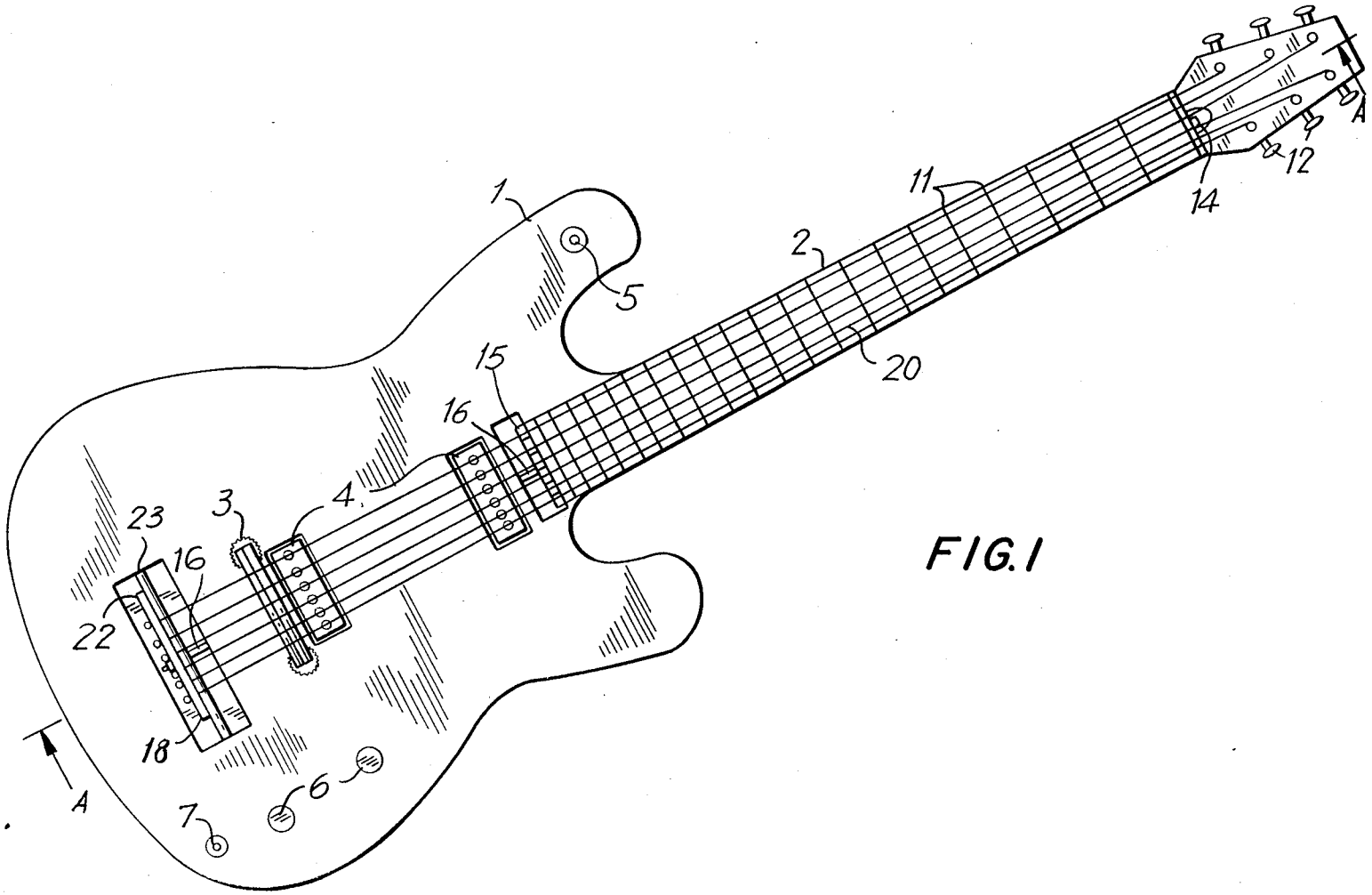
FIG. 1 is a top view of an electric guitar embodying the invention.
Figure 2:
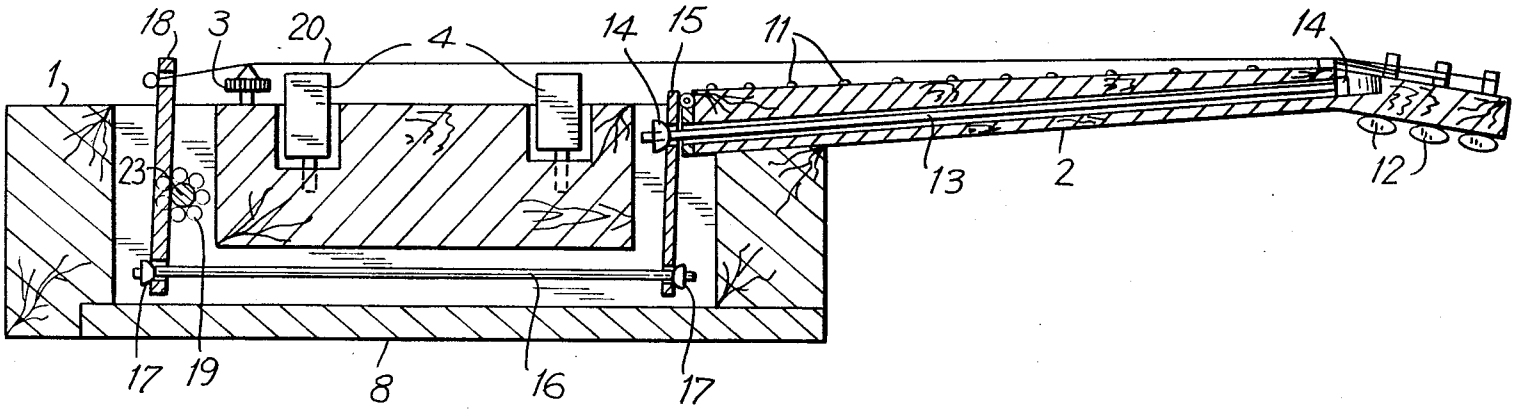
FIG. 2 is a cross section through the guitar of FIG. 1, taken along line A—A.
Figure 3:
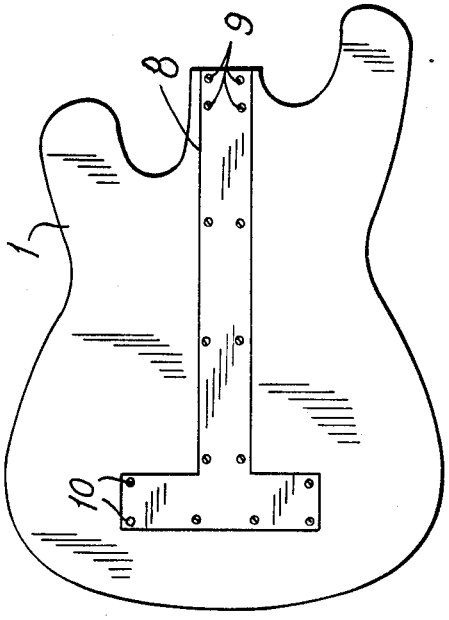
FIG. 3 is a bottom plan view of the body of the guitar of FIG. 1.

The invention will now be described in detail, with reference to the drawings. Referring to FIGS. 1–3, an illustrative embodiment of the invention will be explained.

Body 1 is provided with neck 2, bridge 3, pickups 4, toggle switch 5, controls 6 and output jack 7. The underside of body 1 (FIG. 3) is provided with coverplate 8, made out of metal. Neck-retaining screws 9 extend through coverplate 8 and body 1 and are fastened into neck 2 in order to hold neck 2 to body 1. Coverplate screws 10 affix coverplate 8 to a suitable recess on the underside of body 1. They therefore are shorter than neck-retaining screws 9.

Neck 2 is provided with frets 11 and tuners 12. Trussrod 13 passes through a hollow bore within neck 2, with clearance. Hence, trussrod 13 is free to move within neck 2. Trussrod 13 is made of steel in a conventional diameter. It is provided with adjusting nuts 14 threaded on either end. However, trussrod 13 is longer than normal and extends beyond the heel of neck 2 sufficiently to permit it to engage heel hinge 15, via adjusting nut 14. Heel hinge 15 is connected by pull rod 16 (having adjusting nuts 17) to tailpiece 18, which is mounted to body 1 by bearings 19. Strings 20 pass through apertures 21 in tailpiece 18, and are anchored to tuners 12.

Figure 4:
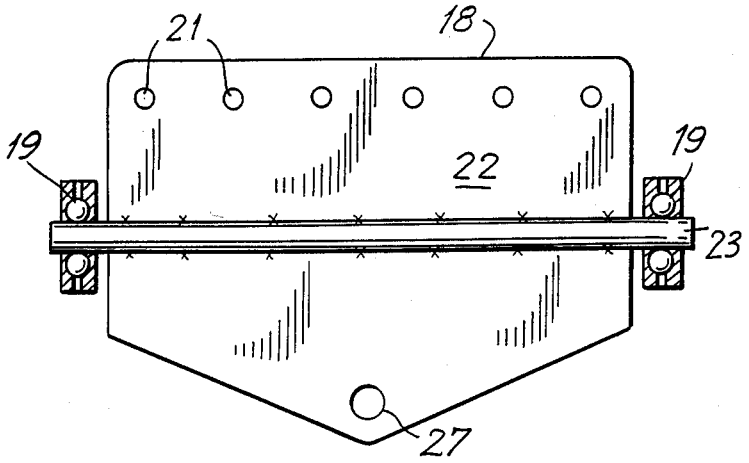
FIG. 4 is a front elevation of a tailpiece according to one embodiment of the invention.

Referring now to FIG. 4, it can be seen that tailpiece 18 constitutes a metal plate 22 welded to shaft 23, which is provided with ball bearings 19. Apertures 21 are provided to receive and retain strings 20. Aperture 27 receives pullrod 16.

Figure 5:
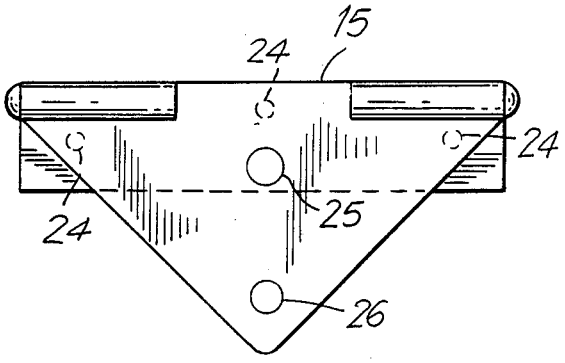
FIG. 5 is a front elevation of a neck heel hinge according to the invention.

Referring now to FIG. 5, it can be seen that heel hinge 15 is provided with apertures 24 for receiving screws for affixing heel hinge 15 to the heel of neck 2. It is further provided with aperture 25 for trussrod 13, and aperture 26 for pullrod 16.

The operation of an instrument according to the invention is as follows. When the instrument is unstrung, heel hinge 15 does not exert any tension on trussrod 13. When strings 20 are installed and gradually tensioned, the extremity of tailpiece 18 to which strings 20 are affixed is gradually drawn towards tuners 12. This causes tailpiece 18 to pivot about bearings 19, such that its lower extremity moves away from tuners 12. Said motion is transmitted by pullrod 16 to the lower extremity of heel hinge 15, and thence to adjusting nut 14 threaded on trussrod 13. Therefore, trussrod 13 comes under tension. As the tension on strings 20 is increased by tightening tuners 12, the tension on trussrod 13 is correspondingly increased. Therefore, the tendancy of strings 20 to warp neck 2 in an upwards direction (looking at FIG. 2) is counteracted by the pull of trussrod 13 in a downwards direction.

It will be appreciated that the placement of shaft 23 on plate 22 of tailpiece 18 may be suitably established so as to equalize the mechanical advantage exerted on the neck by strings 20 and trussrod 13 respectively. It will also be appreciated that if fine-tuning of individual strings 20 is desired,apertures 21 of tailpiece 18 may be replaced by individual fine-tuning mechanisms such as those known in the art (e.g., SHALLER FINE TUNE tailpiece) mounted on tailpiece 18.

Figure 6:
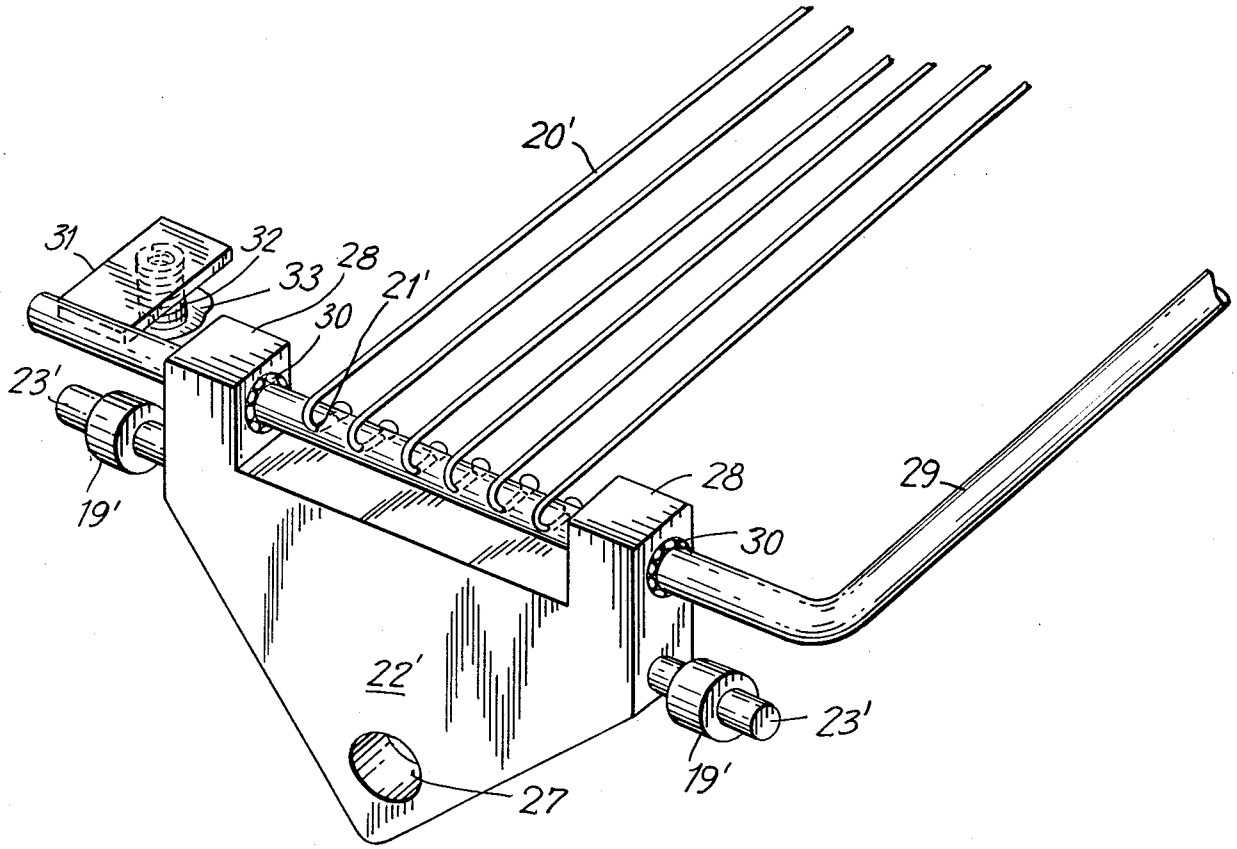
FIG. 6 is a perspective view of a tremolo tailpiece according to an alternate embodiment of the invention.

Referring now to FIG. 6, an alternate embodiment of the invention will be described, in which provision is made for a tremolo feature. In this embodiment, plate 22'is of heavier gauge material (e.g., one-half inch plate). It is provided with forks 28. Vibrato bar 29 passes through forks 28 and is journaled on bearings 30. Vibrato bar 29 is provided with apertures 21' for receiving strings 20'. It is further provided with compression arm 31, to which is welded compression spring 32 which bears upon (but is not affixed to) a protective plate 33 affixed to body 1 (not shown).

In the operation of the embodiment of FIG. 6, tensioning strings 20' compresses spring 32, while simultaneously tensioning trussrod 13 in the manner described above in connection with the previous embodiment. In order further to tension strings 20' the guitarist pulls up on vibrato bar 29. In order to loosen strings 20', one pushes down on vibrato bar 29. In either instance, any tightening or loosening of strings 20' results in a corresponding tensioning or detensioning of trussrod 13. Hence, operation of the tremolo unit of the invention has no tendency to cause movement of the neck.

It will be appreciated that if it is desired to have a tremolo system in which the relative tuning of chords is unaffected by operation of tremolo bar 29, this may be accomplished if the diameter of tremolo bar 29 under each of strings 20' is suitably enlarged or diminished the appropriate amount corresponding to the properties of each individual string 20', as is generally taught in expired U.S. Pat. No. 3,437,001 to Kraft. (See, e.g., FIG. 12 thereof, and related specification).

It will be appreciated that the invention is not limited to the exact embodiments described, but also encompasses such other and further embodiments as would be apparent to one skilled in the art. For example, the invention may be applied to an accoustic guitar if pickups 4 are dispensed with and body 1 is constructed to be hollow, in which event bearings 19 would be anchored to the body's end block. Alternatively, the instrument may be constructed as a headless guitar, similar to the STEINBERGER guitar, if micrometer-style tuners are provided directly on tailpiece 18.

What is claimed is:

1. A stringed musical instrument provided with:

a neck provided with strings having first and second ends, said first ends being anchored to said neck in the region of its string nut;

means for tensioning said strings;

a trussrod internal to said neck, said trussrod having a first and a second extremity, said first extremity being connected to said neck in the region of its string nut and secured against tensional forces exerted on said trussrod at its said second extremity; and a tailpiece comprising a lever pivotally attached to said body and having first and second arms, said first arm anchoring said strings at their said second end, said second arm being connected to transmission means, said transmission means being connected to said second extremity of said trussrod for applying tension thereto substantially in proportion to the tension on said strings.

2. An instrument according to claim 1, said tailpiece being a tremolo tailpiece.

3. An instrument according to claim 1, said transmission means comprising a pullrod and a lever pivotally attached to the heel of said neck.

An instrument according to claim 1, said tailpiece being a tremolo tailpiece.

4. An instrument according to said tailpiece being a tremolo tailpiece.

5. An instrument according to claim 4, said first arm being provided with a tremolo bar rotatably mounted thereon and biased against the tension of said strings.

6. An instrument according to claim 5, each of said strings being attached to said tremolo bar at locations selctively spaced from the axis of said tremolo bar, such that relative tuning of chords is substantially maintained on rotation of said tremolo bar.

7. An instrument according to claim 3, said tailpiece being provided with fine tuners.

* * * * *

UNITED STATES PATENT AND TRADEMARK OFFICE

CERTIFICATE OF CORRECTION

PATENT NO. : 4,930,389

DATED : June 5, 1990

INVENTOR(S) : Robert M. Kunstadt

It is certified that error appears in the above-identified patent and that said Letters Patent is hereby corrected as shown below:

Column 4, lines 29 and 30, should be deleted;

line 31, between the words "to" and "said", insert --claim 1,--.

Signed and Sealed this

Ninth Day of July, 1991

*Attest:*

HARRY F. MANBECK, JR.

*Attesting Officer*

*Commissioner of Patents and Trademarks*